United States Patent [19]

Ingram

[11] 4,392,440

[45] Jul. 12, 1983

[54] MULTI-STITCH CAM NEEDLE BAR SHIFTER FOR TUFTING MACHINES

[75] Inventor: Gary L. Ingram, Ooltewah, Tenn.

[73] Assignee: Spencer Wright Industries, Inc., Chattanooga, Tenn.

[21] Appl. No.: 253,800

[22] Filed: Apr. 13, 1981

[51] Int. Cl.[3] ..... D05C 15/00

[52] U.S. Cl. ..... 112/79 A

[58] Field of Search ..... 112/79 R, 79 A, 117, 112/221

[56] References Cited

U.S. PATENT DOCUMENTS

| | | | |
|---|---|---|---|
| 3,213,813 | 10/1965 | Chambers | 112/79 R |
| 3,964,407 | 6/1976 | Ingram et al. | 112/79 R |
| 3,964,408 | 6/1976 | Smith | 112/79 A |
| 4,173,192 | 11/1979 | Schmidt et al. | 112/79 R |
| 4,201,143 | 3/1980 | Jackson | 112/79 R |
| 4,282,818 | 8/1981 | Ingram | 112/79 R |
| 4,285,287 | 8/1981 | Inman | 112/79 R |

*Primary Examiner*—Ronald Feldbaum

*Attorney, Agent, or Firm*—Alan Ruderman

[57] ABSTRACT

A tufting machine having a pattern cam needle bar shifting mechanism includes an indexing device for driving the cam intermittently so that the cam remains stationary during a portion of the needle bar cycle, that portion being at least during a portion of the time the needles are within the needle plate. A one-way ratchet clutch drive driven from an eccentric on the main shaft of the tufting machine supplies the intermittent motion to the cam in one embodiment of the invention. A positively acting brake to prevent the fly wheel effect on the pattern cam ensures a positive stopping and commencement of the stationary state.

10 Claims, 7 Drawing Figures

MULTI-STITCH CAM NEEDLE BAR SHIFTER FOR TUFTING MACHINES

BACKGROUND OF THE INVENTION

This invention relates to tufting machines and more particularly to apparatus for increasing the range of operation of a cam driven needle bar jogging device by extending the pattern repeat capabilities, i.e. the stitch capacity of a given size cam.

In the production of tufted fabrics it is known to jog or shift the needle bar transversely across the tufting machine relatively to the base material in order to create various pattern effects, to break up the unattractive alignment of the longitudinal rows of tufts and to reduce the affects of streaking which results from variations in coloration of the yarn, the latter difficulty being a result of variations in the dye absorbing property of heat set yarns.

Various devices have been proposed and are in use for controllably applying a step-wise force to the needle bar of the tufting machine in accordance with a pattern. For example, the primary means for supplying this jogging has been a pattern cam driven in timed relationship to the reciprocation of the needle bar and acting upon a cam follower mechanism coupled to the needle bar. Exemplary of this prior art device are U.S. Pat. Nos. 3,026,380 and 3,934,524. Because of the limited patterning capabilities of a cam, and especially the limited longitudinal pattern repeat, the cam providing a longitudinal repeat every revolution of the cam, prior art needle bar shifters having patterning capabilities beyond that provided by the cam and follower systems have been developed. Electrically/electronically programable systems proposed for replacing the cam driven systems are disclosed in U.S. Pat. Nos. 3,964,408 and 3,972,295, which utilize pawl and ratchet devices, U.S. Pat. No. 4,010,700 which uses an indexing device, and U.S. Pat. No. 4,173,192 which uses a hydraulic actuator. A pneumatic actuation system has also been proposed recently and is the subject of copending U.S. application Ser. No. 245,377 filed Mar. 19, 1981 and assigned to the assignee of the present invention.

However, because of the greater reliability, simplicity and lower cost of a cam drive system vis a vis the known expanded pattern needle bar shifters, a cam driven system is still preferable to these others.

In a conventional cam driven needle bar shifter apparatus, the cam is rotatably driven through proper reducing apparatus from the main shaft of the tufting machine and rotates continuously. However, since the lateral shifting of the needle bar must occur only during that portion of the machine cycle when the needles are above the base fabric and needle plate so as to avoid interference between the needles and the needle plate, only a portion of the cam circumference is available for controlling the needle bar movement. The remaining portion of the cam circumference is of a constant radius and non-effective for patterning, it merely idles the needle bar. For example, normally the needle bar is shifted or jogged laterally during approximately 90 degrees to 120 degrees of the needle bar reciprocation cycle, this period corresponding to the period the needles are safely free of the needle plate without imposing excessive acceleration forces on the apparatus. Thus, in a conventional cam driven shifter approximately one quarter to one third of the circumference provides the pattern, with the remaining three quarters to two thirds of the circumference being merely an idle surface. If the surface of the cam is divided into sectors equal in number to the number of stitches in the pattern, the angular distance from a point in one sector to a similarly disposed point in an adjacent sector is the angle the cam must rotate for each revolution of the tufting machine shaft, i.e. for each cycle of the needle bar. Because of this, and because of the small surface available for a follower to ride upon each sector of a practical sized cam, the number of sectors into which the cam may be divided, and hence the number of stitches in a pattern produced by the cam, has been limited.

SUMMARY OF THE INVENTION

The present invention overcomes these deficiencies of the prior art cam drive shifters by intermittently driving the pattern cam so that the cam remains stationary during at least a portion of the time the needles are within the base fabric and needle plate. For example, if the cam is stopped during approximately 180 degrees of the needle bar cycle, the number of stitches or steps that can be placed on the circumference of the cam can be approximately doubled relatively to that of the prior art. Similarly, if the cam remains stationary for approximately the two thirds to three quarters of the time a conventionally driven cam would normally be inactive as a driver, although rotating, the number of stitches could be increased approximately three to four times respectively.

One aspect of the present invention is the provision of an indexing device in the cam drive system, the indexing device converting the continuous motion taken from the rotation of the main shaft into intermittent motion at the cam so that the cam remains stationary during the normally inactive portion when it does not effect movement of the needle bar. Thus, with an indexing device providing, for example, a 90 degree output for a 360 degrees input, the cam is stationary for three quarters of each revolution of the tufting machine main shaft, and rotates for one quarter of the main shaft rotation, thereby allowing the placement of an approximately four fold increase in the number of drive steps about the periphery of a given size cam, i.e. for a given size cam the number of stitches in the pattern before a repeat can be increased approximately four fold.

Another aspect of the invention is the provision of a rotary one-way ratchet clutch drive intermediate the tufting machine main shaft and the pattern cam for providing the intermittent motion, the rotary motion of the main shaft being first converted into a reciprocating motion for cranking the pawl which turns the ratchet wheel thereby driving the pattern cam only during approximately 180 degrees of rotation of the main shaft, the cam being stationary during the remainder of the cycle of the main shaft rotation. By proper selection of the ratchet wheel and the cranking stroke, the angular movement of the cam may be selected within this 180 degree period. Thus, the number of drive steps or stitches that may be placed in a pattern on the cam may be approximately doubled vis a vis the prior art.

Another aspect of the invention is the provision of a positive brake for overcoming the momentum or flywheel effect of the pattern cam after it has been rotated to ensure a positive stopping at the end of the index period and commencement of the stationary state of the cam.

Consequently, it is a primary object of the present invention to provide an intermittently driven pattern cam for laterally shifting the needle bar of a tufting machine thereby to increase the number of stitches in the pattern stored in the cam.

It is another object of the present invention to drive a pattern cam of a tufting machine needle bar shifter during only a portion of the reciprocating cycle of the needle bar, that portion corresponding to the period of time the information on the cam can be utilized, and to stop the cam from rotation during the remaining portion of the needle bar cycle when the information on the cam is not usable.

It is a further object of the present invention to provide a simple intermittent drive using a rotatable ratchet clutch for driving the pattern cam of a tufting machine needle bar cam driven shifter apparatus during only a portion of the needle bar reciprocation cycle and for stopping the rotation of the cam during the remainder of the cycle thereby permitting the information stored on the cam to be increased so that the number of stitches of a pattern may be increased before the pattern is repeated.

It is a still further object of the present invention to provide an intermittently driven tufting machine needle bar cam shifter having a stationary period during a portion of the needle bar reciprocation cycle, the cam being provided with a positive stopping action to commence the stationary period.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENTS

Figure 3:
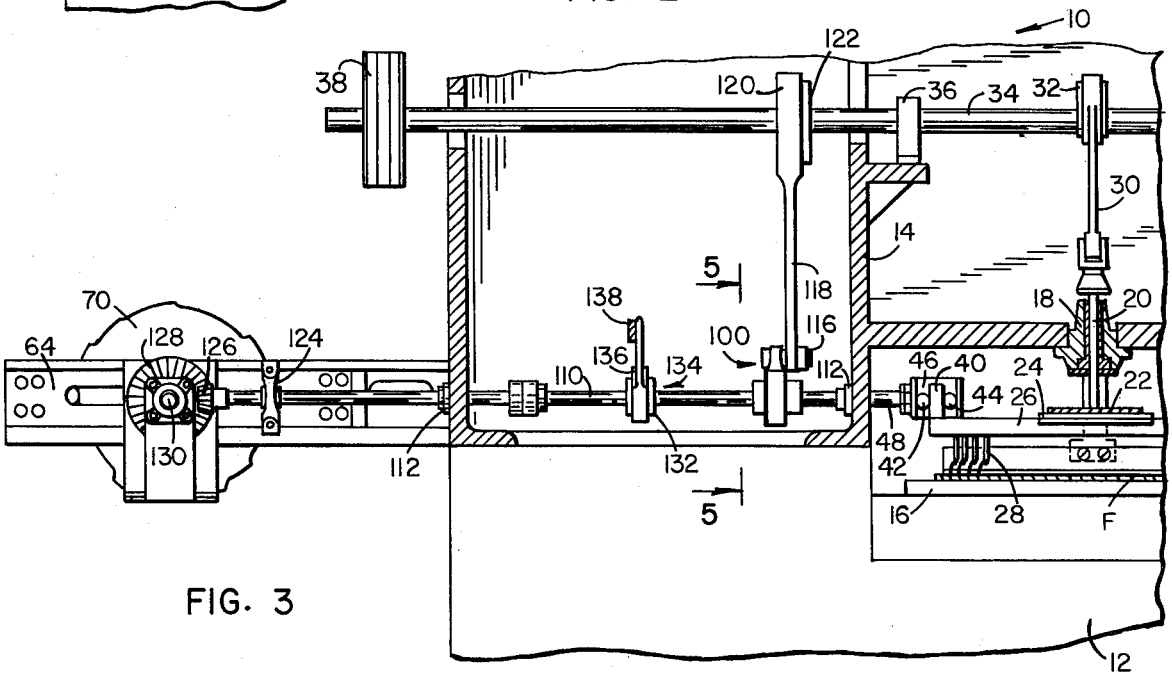
FIG. 3 is a fragmentary front vertical sectional view through a tufting machine incorporating a cam driven needle bar shifter, the cam being intermittently driven through a ratchet drive in accordance with a feature of the present invention.
Figure 4:
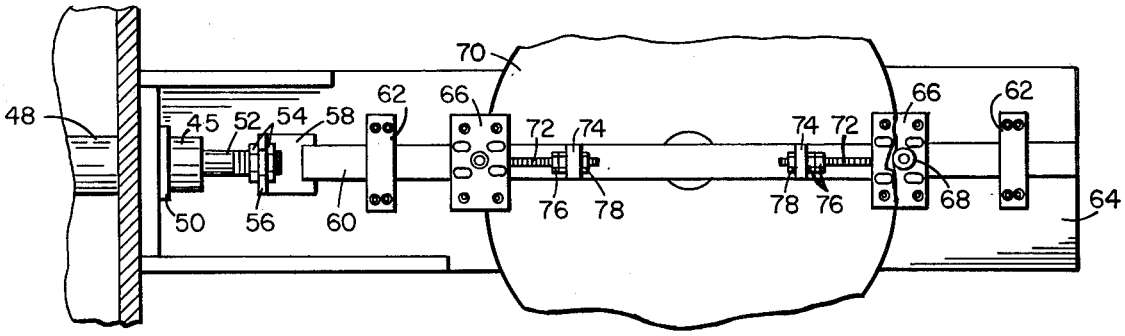
FIG. 4 is a fragmentary rear elevational view of a portion of the shifter mechanism illustrated in FIG. 3.

Referring now to the drawings there is illustrated in FIG. 3 a portion of a tufting machine 10 having a frame comprising a base 12 and a head 14 disposed above the base. The base 12 includes a needle plate 16 over which a backing fabric F is adapted to be fed in a conventional manner.

Mounted in the head 14 for vertical reciprocation within a bushing assembly 18 is one of a plurality of push rods 20 to the lower end of which a needle bar support foot 22 is carried. The support foot 22 has a substantially inverted U-shaped configuration in end elevation including undercut flanges 24 at the extremities to form a guide-way. A needle bar 26 substantially conforming in shape to the interior of the support feet so as to be slideably received therein is positioned within the guide-way of the support feet. The needle bar 26 may thus reciprocate with the push rods 20 and slide laterally relatively thereto.

The needle bar 26 carries a plurality of needles 28 that are adapted to penetrate the fabric F on the needle plate 16 upon reciprocation of the needle bar 26 to project loops of yarn therethrough. End-wise reciprocation is imparted to the push rods 20 and thus the support feet 22 and the needle bar 26 and needles 28 by a link or connecting rod 30 which is pivotably connected at its lower end the push rods 20 and at its upper end to an eccentric cam 32 on a driven rotary main shaft 34 that is journalled longitudinally in bearing blocks 36 mounted in the head. The shaft 34 may be conventionally driven by, for example, a drive pulley 38 receiving its motion from an electric motor driven belt (not illustrated). Although not illustrated, a plurality of hooks or loopers are mounted in the base of the machine and are driven in timed relationship with the needles to seize loops of yarn presented by the respective needle as is notoriously well-known in the art.

In order to drive the needle bar 26 selectively with controlled lateral movement, the needle bar 26 is provided with an upstanding plate member 40 which is straddled by a pair of rollers 42, 44 pivotably mounted on a mounting plate 46 secured to the end of a drive rod 48, the drive rod may therefore reciprocate laterally to drive the needle bar while allowing the needle bar to reciprocate vertically. The drive rod 48 extends laterally through bearings 50, only one of which is illustrated, and out the end of the tufting machine frame. A connecting member 52 is axially secured to the end of the rod 48 and includes threads at its other end for receiving a pair of spaced nuts 54. The threaded portion of the connecting member 52 extends between a slot in a bracket 56 secured to a coupling member 58, the nuts 54 straddling a wall 56 adjacent the slot and secured thereto so that the drive rod 48 can oscillate laterally together with the coupling member 58. The coupling member 58 is fastened to a bar or rod 60 journalled in brass bearings 62 fastened to a frame 64 secured to the end of the tufting machine head 14. Mounted on the rod 60 are a pair of spaced follower carrying brackets 66, each of which rotatably carries a roller type follower 68. Each of the rollers engages diametrically opposed peripheral edges of the pattern cam 70 which is rotatably journalled on the support bracket 64. The follower bracket 66 may be adjusted along the bar 60 by means of threaded members 72 having one end abutting the respective follower bracket 66 and secured to blocks 74 fastened to the bar 60, lock nuts 76, 78 securing the member 72 to the block 74.

Figure 1:
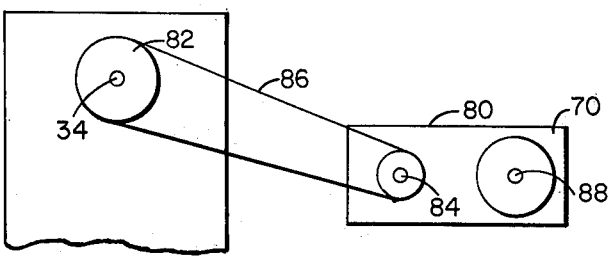
PRIOR ART FIG. 1
FIG. 1 is a diagramatic view of the prior art drive for a tufting machine pattern cam needle bar shifter.

With reference to FIG. 1, it has been conventional to drive the cam 70 by means of a speed reducing unit 80 interposed between the main shaft 34 of the tufting machine by, for example, a sprocket member 82 mounted on the end of the main shaft and driving the input 84 of the reducer through a chain 86, the cam 70 being mounted of the output shaft 88 of the reducer. In this manner the pattern cam 70 is driven constantly with the main shaft 34, albeit it only makes $1 \div N$ of a revolution for each revolution of the main shaft, where N is the number of stitches in the pattern. Since, as aforesaid, only one quarter to one third of the circumference of the cam during its rotation is effective for providing the lateral shaft to the needle bar, the cam conventionally is rotated wastefully.

Figure 2:
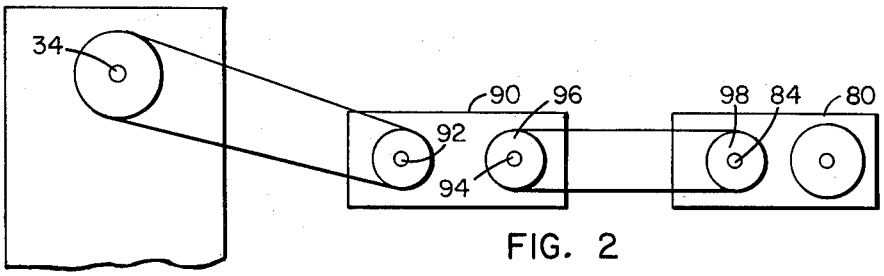
FIG. 2 is a diagramatic view of the drive for an intermittently driven pattern cam for a tufting machine needle bar shifter according to the principles of the present invention.

Referring to FIG. 2 one aspect of the present invention is the incorporation of a conventional indexing device 90 intermediate the tufting machine main shaft 34 and the input shaft 84 of the reducer 80. The main shaft 34 is thusly connected to the input 92 of the index device 90, and the output 94 of the device 90 is coupled to the input 84 of the reducer 80. Any of a number of available index devices for converting continuous rotary motion at the input shaft to intermittent rotary motion at the output shaft, such as a Ferguson model P5-4FM150-120 or a Camco parallel drive model 1200-P4H96-120 may be utilized as the index device 90. A Ferguson type drive is disclosed in U.S. Pat. No. 3,572,173. The Camco parallel drive index devices use a cam on an input shaft and a follower on an output shaft, the cam having a dwell portion and are manufactured by Emerson Electric Company of Chicago, Ill. Moreover a conventional Geneva drive may provide the intermittent rotation to the cam 70. With an index device such as the aforesaid Ferguson and Camco models, the output shaft makes one quarter of a turn for each full revolution at the input. Such an index box is considered to be a four stop box. The index period for each of these index box models is 120 degrees, i.e. indexing occurs within 120 degrees while the dwell is 240 degrees. Thus, the output of the index device provides a 90 degree output rotation for 120 degrees of input rotation and is then stopped for the remaining 240 degrees of the input rotation. By proper selection of the output pulley or sprocket 96 on the index device and the input pulley or sprocket 98 on the reducer 80, the cam may be rotated through the desired angle equal to 360 degrees÷the number of stitches on the cam during one quarter of the rotation of the main shaft and remain stationary during the remainder of the main shaft rotation. Although the aforementioned Ferguson and Camco index drives provide good results other index drives such as one where the output moves 90 degrees for 90 degrees of input and stopped during the remaining 270 degrees can be used. The only limitations are that the output angle should be less than the time the needles would be above the needle plate and base material and more time than that which would provide too great an acceleration on the needle bar and the connecting elements. Moreover, a three stop, six stop etc. index box can be used by changing the sprockets or the reducer.

Figure 6:
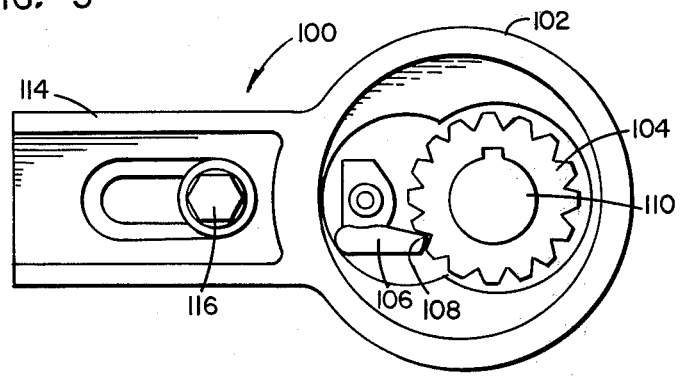
FIG. 6 is a view similar to FIG. 5 of a fragment of the ratchet drive greatly enlarged.

Under another aspect of the invention, because of its simplicity and ease of adaptability, the present invention provides an indexing device in the form of a one-way ratchet clutch illustrated generally at 100 in FIG. 3. Under this aspect of the invention rotary motion of the main shaft 34 is converted into reciprocating motion for cranking the lever arm of the ratchet clutch to intermittently drive the ratchet wheel during 180 degrees of the main shaft rotation. Thus, the ratchet clutch includes a housing 102 for journally mounting a rotatably center gear 104 in a suitable bearing (not illustrated). The housing also carries a spring biased pawl 106 having a tapered edge 108 receivable within the valleys between adjacent teeth of the gear 104. The angular relationship at the edge 108 of the pawl is such that the pawl cam drives the gear wheel 104 in one direction, that being clockwise when the pawl is moved downwardly as illustrated in FIG. 6, but slips over the gear 104 when the pawl is moved upwardly in FIG. 6.

Figure 5:
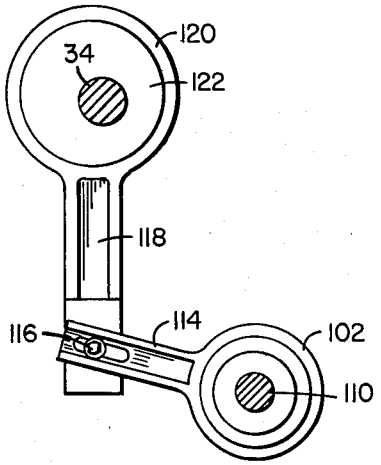
FIG. 5 is a cross sectional view taken substantially along line 5—5 of FIG. 3.

The gear 104 is keyed onto a shaft 110 journalled laterally in bearings 112 in the head of the tufting machine. The housing 102 of the ratchet clutch include an elongated extension 114 remote from the gear mounting portion. As best illustrated in FIG. 5, the extension 114 is pivotably connected by means of a journal pin 116 to the end of a pitman rod 118 having an eccentric strap connecting portion 120 positioned about a circular cam 122 eccentrically mounted on the main shaft 34 of the tufting machine. Thus, as the main shaft rotates the reciprocating motion of the pitman arm 118 provides a substantially vertical cranking motion to the extension arm 114 which indexes the gear wheel 104 during 180 degrees of the main shaft rotation, this occurring during the downward stroke of the pitman arm 118 as illustrated in the drawings.

The shaft 110 extends in a direction toward the cam 70 and is supported on the bracket 64 by a bearing block 124, the shaft including a bevel gear 126 fastened on its free end. The bevel gear 126 drivingly meshes with a bevel gear 128 fast on the same shaft 130 to which the pattern cam 70 is fastened so that rotation of the shaft 110 effects a rotation of the cam 70, and when the shaft 110 dwells the cam 70 likewise is stationary. Positioned on the shaft 110 is one part 132 of a conventional one-way clutch 134, the other part 136 being secured to a stationary bracket in the head of the tufting machine. The clutch 134 is of a conventional construction and functions to prevent motion in the opposite direction to that permitted by the ratchet clutch 100 thereby providing resistance to the shaft 110 to ensure that the ratchet clutch can always drive against a resistance and that the pawl 106 can drive intermittently in a step-by-step manner.

With this construction it should be understood that the shaft 110 rotates during 180 degrees of rotation of the main shaft and is stationary for the other 180 degrees. The actual amount of rotation which the shaft 110 undergoes during the 180 degree period of motion of the main shaft is dependent upon the number of teeth in the ratchet wheel 104 and the stroke of the pitman rod 118. These factors together with the gear ratio of the bevel gears 128 and 126 determine the angular rotation that the cam undergoes during one complete rotation of the main shaft 34. Thus, since rotation of the cam only occurs during half of the tufting machine cycle the number of pattern steps or stitches that may be placed about the periphery of the cam 70 is substantially twice that of the prior art.

Figure 7:
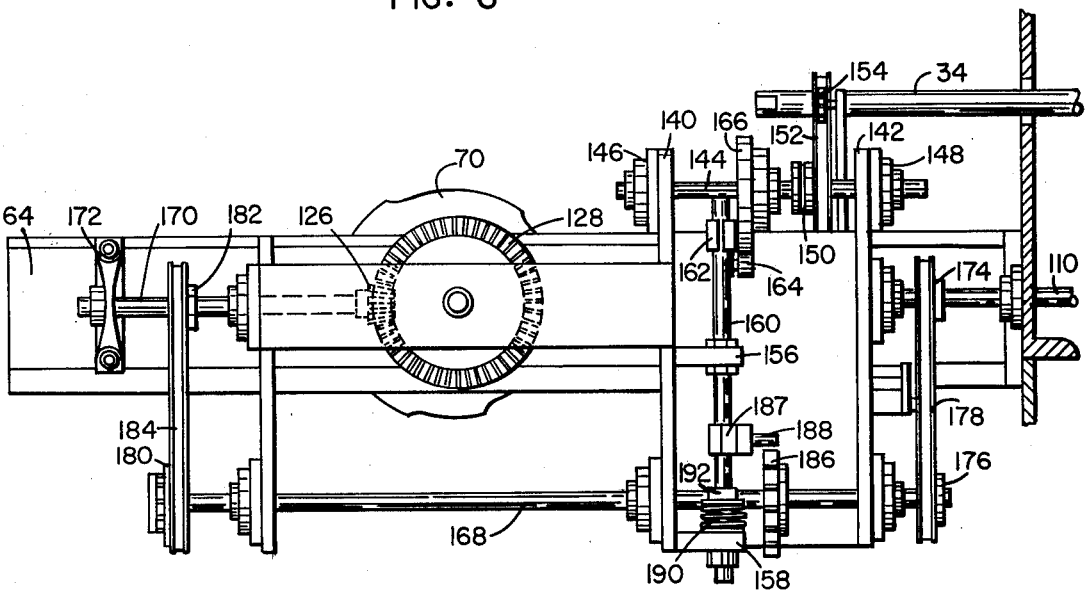
FIG. 7 is a front elevational view of a modified form of the structure illustrated in FIG. 3 incorporating a positive brake for the pattern cam.

To ensure that the cam 70 at the end of each of its rotational index periods positively stops to start the stationary or dwell period and does not create a fly wheel effect to drive the shaft 110 and ratchet due to its own momentum, the present invention provides a positive brake construction as illustrated in FIG. 7. To this end a pair of spaced plates 140, 142 may be secured to the bracket 64 for journally mounting a stud shaft 144 in bearings 146, 148 carried by the plates 140, 142. Fastened on the stud shaft 144 is an adjustable sprocket member 150 and is driven by a chain 152 from a sprocket 154 fastened on the main shaft 34. The plate 140 carries a pair of vertically spaced platforms 156, 158 which in turn journally carry a substantially vertical rod 160. A first collar 162 is fastened to the rod 160 at an upper portion thereof and carries a follower 164. The follower is disposed to engage a brake cam 166 fastened to the stud shaft 144. Cam 166 includes at least one lobe or high point positioned on the cam so as to drive the follower 164 and thus the rod 160 downwardly at the beginning of each dwell period of the ratchet 100.

The intermittently driven drive shaft 110, to avoid interference with the rod 160 as illustrated in FIG. 7 may take an indirect route to the cam 70 by means of a shaft 168 driven from the shaft 110 and which in turn drives another shaft 170 journally mounted on the bracket 64 in a bearing block 172. Thus, a sprocket 174 is mounted on the shaft 110 and drives a sprocket 176 mounted on the shaft 168 by means of a chain 178, and a second sprocket 180, preferrably adjustable, mounted on the other end of the shaft 168 drives the shaft 170 through a sprocket 182 mounted on the shaft 170 and a chain 184. The bevel gear 126 is mounted on the shaft 170 for driving the bevel gear 128 and thus the pattern cam.

Mounted on the shaft 168 is a brake gear 186 having the same number of teeth as the ratchet wheel gear 104. A collar 187 is mounted on the rod 160 and carries a lock pin 188 disposed above the gear 186 and adapted to enter between the teeth of the gear 186 whenever the cam 166 drives the follower 164 and thus the rod 160 downwardly. A spring 190 is coiled about the rod 160 below the collar 187 and acts against a collar 192 fastened to the rod 160 to ensure engagement of the follower 164 with the brake cam 166. Consequently, whenever the ratchet wheel 104 is rotating during the 180 degree index portion of the main shaft rotation, the cam 166 maintains the follower 164 in an upward position so that the brake gear 186 is free to rotate, but during the stationary portion of the main shaft rotation when the ratchet wheel dwells the cam 164 is at least initially driven downwardly to force the lock pin 188 into the valley between a pair of teeth of the gear 186 to ensure a positive stopping of the shaft 168 and thus the pattern cam 70.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention what is claimed herein is:

1. In a tufting machine having a reciprocating needle bar carrying a plurality of needles spaced transversely across the machine and adapted to penetrate a base material moving longitudinally across a support plate thereof to insert a plurality of stitches upon each penetration of the base material, mounting means for mounting said needle bar for transverse movement relatively to the base material, a rotatably mounted cam having stitch pattern information for directing the movement of the needle bar, follower means responsive to the stitch pattern information on said cam, means connecting said follower means to said needle bar for selectively shifting said needle bar transversely in accordance with the stitch pattern information on said cam, and cam drive means for rotatably driving said cam, said cam drive means comprising an index drive having input means continuously driveable through a repetitive cycle and output means driven by the input means during only an index portion of the cycle of the input means and being stationary during the remainder of the cycle of the input means, means for driving said input means in time relationship with the reciprocation of the needle bar such that said input means and said needle bar have a common cycle, and means operatively connecting said output means to said cam for rotatably driving said cam intermittently to stop the rotation of said cam at least during a portion of the time the needles are within the base material.

2. In a tufting machine as recited in claim 1, including a shaft cyclically driven in timed relationship with the reciprocation of said needle bar, said means for driving said input means comprising means drivingly interconnecting said shaft and said input means.

3. In a tufting machine as recited in claim 1, wherein said index drive comprises a ratchet drive, said output means comprising a ratchet tooth wheel and said input means including a pawl drivingly engaged with said tooth wheel during said index portion of the cycle and disengaged during the remainder of the cycle.

4. In a tufting machine as recited in claim 2, wherein said index drive comprises a ratchet drive, said input means comprising a body member, and a pawl pivotably carried by said body member, said output means comprising a ratchet tooth wheel rotatably mounted in said body member and disposed for engagement with said pawl between a pair of teeth, said pawl having a configuration rotatably driving said wheel when said body member is pivoted in one direction and slipping over said wheel when said body member is pivoted in the other direction.

5. In a tufting machine as recited in claim 4, wherein said means for driving said input means includes an eccentric mounted on said shaft, a pitman rod having one end drivingly connected to said eccentric and another end connected to said body member, and said means operatively connecting said output means to said cam comprising a rotatably mounted rod means drivingly connected to said tooth wheel and to said cam.

6. In a tufting machine as recited in claim 5, wherein the axis of said shift is substantially parallel to the axis of said rod.

7. In a tufting machine as recited in claim 5, including a one-way clutch disposed on said rod means for providing resistance but permitting rotation of said rod in said one direction only.

8. In a tufting machine as recited in claim 3, including brake means for positively stopping rotation of said cam at the termination of said index portion of the cycle.

9. In a tufting machine as recited in claim 5, including brake means for positively stopping rotation of said rod means at the termination of said index portion of said cycle.

10. In a tufting machine as recited in claim 9, wherein said brake means includes a brake gear having a plurality of spaced teeth mounted on said rod means, and locking means driven in timed relationship with said shaft for entering between adjacent teeth of said brake gear to prevent rotation thereof and for exiting from between said teeth of said brake gear to permit rotation thereof, said locking means permitting rotation during said index portion and preventing rotation during the remainder of said cycle.

* * * * *